United States Patent [19]

Walsh

[11] 4,088,880

[45] May 9, 1978

[54] DECORATIVE FOUNTAIN

[76] Inventor: Glenn Walsh, 2907 Ashley Rd., Huntingdon Valley, Pa. 19006

[21] Appl. No.: 667,910

[22] Filed: Mar. 17, 1976

[51] Int. Cl.[2] ..... F21P 7/00

[52] U.S. Cl. ..... 362/96; 239/18

[58] Field of Search ..... 239/16–20, 239/22, 23; 240/10 CH, 2.25, 26, 2 LF

[56] References Cited

U.S. PATENT DOCUMENTS

| | | | |
|---|---|---|---|
| 1,506,302 | 8/1924 | Hopkins | 240/10.6 CH |
| 1,837,732 | 12/1931 | Stabler | 239/20 |
| 1,885,830 | 11/1932 | Hutchings et al. | 239/20 |
| 3,030,028 | 4/1962 | Hruby, Jr. | 239/17 |
| 3,235,877 | 2/1966 | Grob | 239/17 |
| 3,462,132 | 8/1969 | Kaelin | 261/87 |
| 3,542,292 | 11/1970 | Chase et al. | 239/20 |
| 3,614,417 | 10/1971 | Sanford | 240/26 X |
| 3,689,759 | 9/1972 | Dill | 240/26 X |
| 3,748,457 | 7/1973 | Balitzky et al. | 240/26 X |
| 3,794,825 | 2/1974 | Krupansky | 240/26 X |
| 3,801,812 | 4/1974 | Palumbo et al. | 240/26 X |
| 3,814,317 | 6/1974 | Hruby, Jr. | 239/18 |
| 3,838,816 | 10/1974 | Huff et al. | 239/18 |
| 3,852,587 | 12/1974 | Koehler | 240/26 X |
| 3,864,562 | 2/1975 | Hawkins | 240/10.6 CH X |
| 3,889,880 | 6/1975 | Hruby, Jr. | 239/18 |
| 3,952,190 | 4/1976 | Perkins | 240/26 |

*Primary Examiner*—Joseph F. Peters, Jr.
*Assistant Examiner*—Michael Mar
*Attorney, Agent, or Firm*—Kenneth P. Synnestvedt

[57] ABSTRACT

A decorative fountain especially adapted for use in a swimming pool, the fountain being adapted to float at the surface of the pool and incorporating a sealed beam light bulb for illumination of the fountain display, and further embodying a self-contained source of electrical current for the light bulb.

6 Claims, 3 Drawing Figures

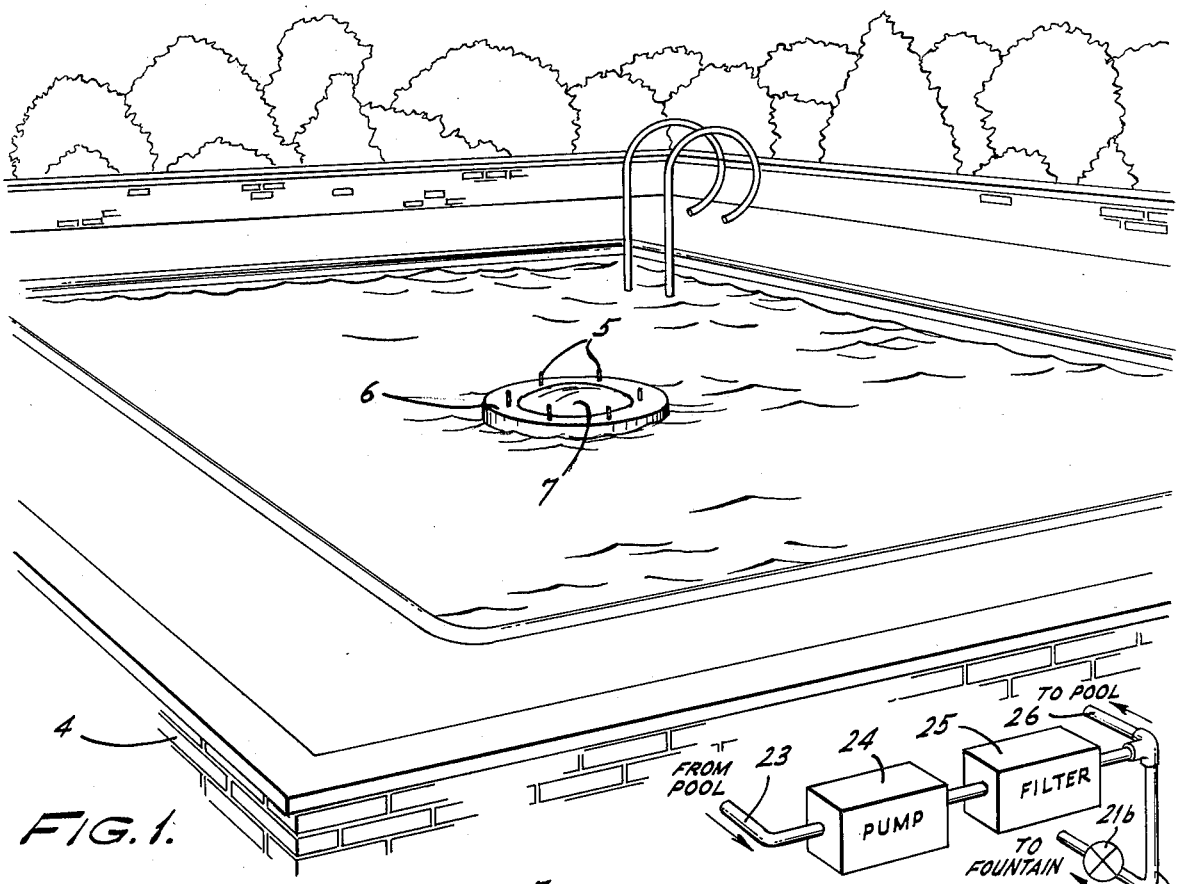
FIG. 1.
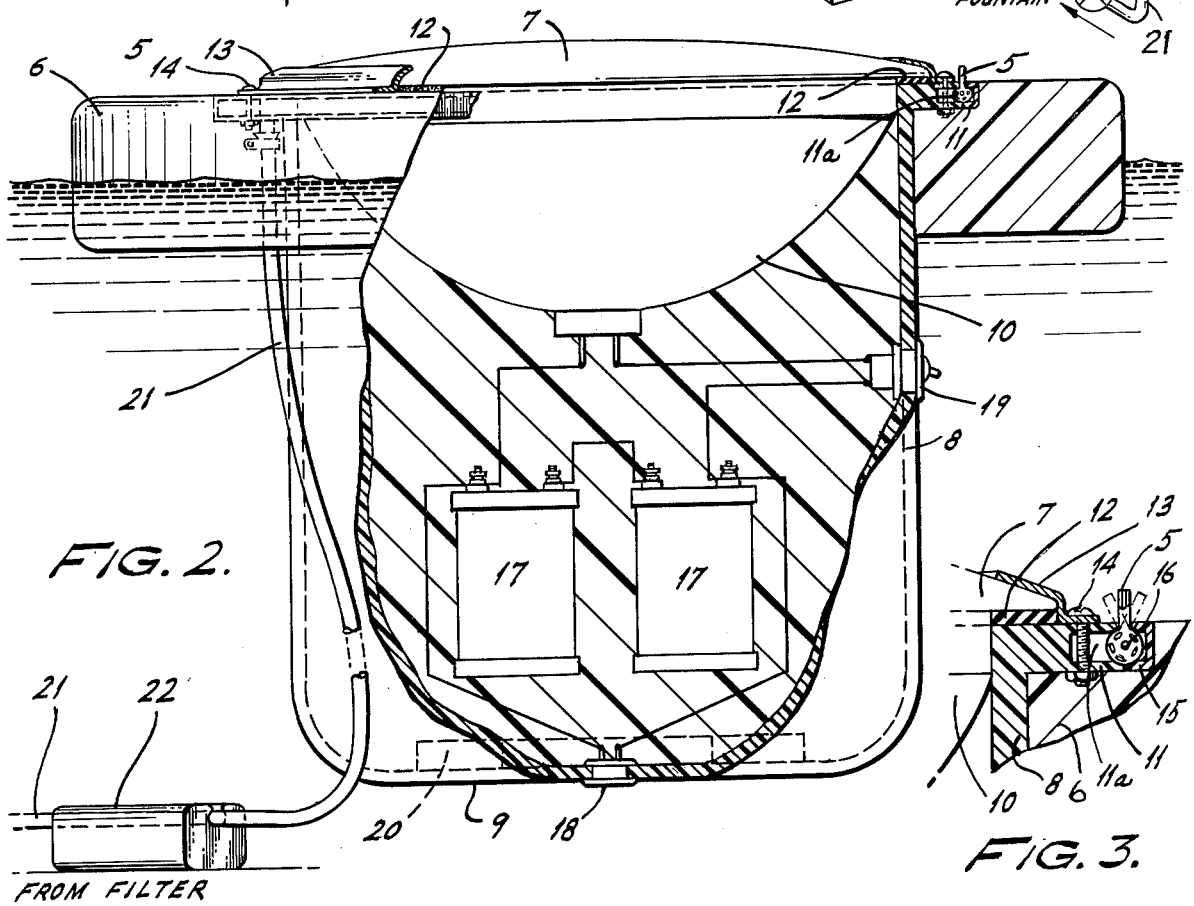
FIG. 2.
FIG. 3.

DECORATIVE FOUNTAIN

The present invention provides a decorative lighted fountain, and while not limited to such use, the device of the invention is especially adapted for use in swimming pools, such as commonly employed as an adjunct to residences, or to apartment buildings or complexes.

In many situations where such swimming pools are provided, there are times when the pool serves as a decorative feature of the environment surrounding the building or buildings with which it is associated, and at many of such times the pool is not employed for swimming. It is an object of the invention to provide a fountain particularly adapted to contribute to the decoration of the environment surrounding the pool, when the pool is not being used for swimming, but it is also an object of the invention to provide a decorative fountain which presents no hazards to swimmers, notwithstanding the fact that the fountain is electrically lighted, and which may therefore be used for decorative purposes even when the pool is also being used for swimming.

Another object of the invention is to provide a decorative lighted fountain having a self-contained electrical power source and being of very simple and inexpensive construction.

Still further, it is an object of the invention to provide such a decorative fountain having a plurality of water discharge or spray nozzles and being of such mass and displacement that the discharge orifices of the spray nozzles are positioned above the water level.

A further object of the invention is to provide a lighted decorative fountain having floatation means arranged in a manner to afford stability to the fountain and ensure maintenance of the fountain in a position in which the streams of water and the light are directed vertically upwardly in the desired positions.

Another object of the invention is to provide a plurality of individual water discharge nozzles each of which is angularly adjustable, so that the fountain display may be altered.

Another object of the invention is to provide a decorative fountain of the kind referred to adapted to utilize certain well known commonly available forms of light bulbs, i.e., light bulbs of the sealed beam type such as those commonly used for automobile head lights.

The device of the present invention is particularly adapted for use in swimming pools embodying the usual water recirculation system, including a water pump and filter and it is an object of the present invention to provide for supply of the fountain from the recirculation system of the pump.

How the foregoing objects and advantages are attained will appear more fully from the accompanying drawings in which:

FIG. 1 is a general perspective view of a swimming pool and illustrating a fountain device according to the invention floating in the pool and further diagrammatically illustrating the water recirculation system;

FIG. 2 is an enlarged elevational view of a fountain constructed according to the invention, this view being partly broken away and shown in section; and FIG. 3 is a further enlarged detailed section view illustrating an adjustable nozzle.

Although the device of the present invention may be used with any type of pool, FIG. 1 illustrates a swimming pool formed within masonry walls 4. A decorative fountain according to the invention is shown floating on the water in the pool, the major components of which are visible in FIG. 1, namely the spray nozzles 5, the floatation ring 6 and the lens 7 of the central light bulb.

As seen in FIG. 2, the main body of the device comprises a casing 8 of generally cylindrical form, having a closed bottom as indicated at 9 and having its upper end open to receive the light bulb. The casing may be made of sheet metal, but advantageously is molded of plastic material.

As above mentioned, it is contemplated that the light bulb employed be of the general type commonly available for use in automobile head lamps and sometimes referred to as "sealed beam" bulbs. A bulb of this type is provided with a base portion 10 having an interior dished reflector lying behind the filament as is well known, and having a lens indicated at 7 through which the light beam is projected. The base portion 10 of the bulb is received in the upper open end of the casing 8, and the edge of the lens 7 projects outwardly to overlap the upper edge of the casing, as clearly appears in FIG. 2.

At its upper open edge, the casing is provided with a hollow projecting flange or lip 11 which serves several purposes, as follows.

First, the flange 11 provides a support for the spray nozzles 5 and the interior hollow forms an annular manifold 11*a* for delivering water to the spray nozzles. Still further, the flange 11 cooperates with the sealing gasket 12 which is positioned between the edge portion of the lens 7 of the bulb and the flange 11, thereby providing a water tight seal between the bulb and the casing. Clamps 13 with fastening bolts 14 provide for attachment of the bulb to the casing and also for tightening of the seal.

At the point of installation of each nozzle 5, the outer edge portion 15 of the flange 11 is formed as a separable part which may be "snapped" in place or which may be held in place by the surrounding floatation ring 6. Each nozzle 5 is provided with an apertured spherical device indicated at 16, and each separable part 15 and the adjacent portions of the flange are shaped to provide a socket in which the sphere or ball 16 may be rotated, in order to provide for annular adjustment of the nozzle 5, all as shown in FIG. 3. The water supplied to each nozzle enters the ball 16 through the apertures therein and is thus delivered to the nozzle itself for upward discharge.

The casing 8 is provided with a chamber underlying the light bulb in order to accommodate the batteries indicated at 17, which may be disposable and replaceable but which may also be of the rechargeable type in which case the batteries are connected as indicated with a recharging fitting 18 at the bottom of the casing. The batteries are also connected with the light bulb through a control switch 19. Both the fitting 18 and the switch 19 are of course of waterproof type, so that the interior of the casing is water tight.

The battery 17 is desirably positioned within the casing by means of packing elements formed of foamed polystyrene, for instance packing elements of the kind commonly employed in shipping cartons. To contribute stability, the bottom end of the casing is preferably weighted, and for this purpose, an annular lead or other metal weight 20 is positioned inside of the casing at the bottom wall.

The floatation ring 6 surrounding the upper end of the casing is also desirably formed of foamed polystyrene or similar foamed plastics. Water is supplied to the manifold 11*a* which in turn supplies the spray nozzles 5 by means of a flexible hose 21 which is connected at one end to the manifold as appears in FIG. 2. This flexible hose 21 is weighted as indicated at 22 and the hose is of sufficient length so that the weight 22 will rest on the bottom of the pool thereby anchoring the fountain in the desired area of the pool. As shown in FIG. 1 the water recirculation system for the pool includes the pool outlet 23, the water recirculation pump 24 and the filter 25 having a discharge or return line 26. A branch line 21*a* is connected with the return pipe 26 and serves to deliver water to the flexible connection 21 for the fountain. The flexible connection 21 may comprise any flexible tubing, such as garden hose, and a common screw connector may be employed to attach the flexible connection 21 to the branch line 21*a* above referred to. This separable connection may be provided at any convenient point below or above the water level in the pool. The connection 21*a* may be provided with a shut-off valve 21*b*, although this shut off would not necessarily be required, provided the connection is positioned to deliver the water to the pool even when the fountain was separated and removed.

According to the foregoing an exceedingly simple and inexpensive form of display fountain is provided having numerous advantageous features which have already been mentioned above. It is particularly to be noted that the lighting system has a self-contained source of light namely batteries within the casing so that no electrical current is required when the fountain is in use. This is an important safety feature because it eliminates hazard of electrical shock to swimmers or others in the area. It is also of importance that the bulb employed is of low voltage battery operated type (for instance 12 volts), since this minimizes the danger of electrical shock.

The use of a sealed beam type of bulb as described, having a lens as indicated at 7, makes possible a convenient water tight sealing arrangement by using a gasket between the projecting flange of the casing and the projecting lip of the lens. This type of bulb is also highly desirable for the present purpose because of the fact that the glass employed, particularly in the lens, is capable of withstanding the chilling action of water without danger of cracking.

The overall weight and displacement of the unit are such as to provide for floatation of the unit to the surface of the pool in a position in which the discharge orifices of the nozzles are just above the level of the water in the pool, thereby ensuring the desired fountain display action.

I claim:

1. A lighted fountain comprising a casing having side and bottom walls and having an upwardly presented opening, a light source comprising a sealed beam electric light bulb, with a broad lens directing light upwardly, the broad lens substantially closing the opening of the casing and the peripheral portion of the broad lens being mounted on and having a waterproof seal with the side wall of the casing around said opening, the bulb having a base received in the opening of the casing, a rechargeable battery for supplying operating current for the bulb, the casing having a chamber below the light bulb accommodating the base of the bulb and the battery, the casing walls being imperforate except for said upwardly presented opening, so that the casing walls and said broad lens completely enclose the base portion of the bulb and the battery, a buoyant ring surrounding the upper portion of the casing, a ballast weight at the bottom of the casing chamber, a series of adjustable fountain spray nozzles spaced around the lens and directed upwardly in position to be lighted by the bulb, and water supply means for the spray nozzles including an annular water supply manifold extending around the broad lens and a flexible water supply hose communicating with the manifold.

2. A fountain as defined in claim 1 in which the displacement and the weight of the fountain including its buoyant ring provides for floatation of the fountain in water with the discharge ends of the series of spray nozzles positioned above the water level.

3. A fountain as defined in claim 1 and further including mounting means for the nozzles providing for angular adjustment of the axes of the nozzles with respect to the vertical.

4. A fountain as defined in claim 1 and further having a waterproof battery charging connection in a lower region of the casing.

5. A fountain as defined in claim 1 and further including a weight carried by the hose and serving to anchor the fountain.

6. A lighted fountain as defined in claim 1 and further including a light switch having an operating element projecting externally of the casing below the water level.

* * * * *